US008308910B2

(12) United States Patent
Mikkonen et al.

(10) Patent No.: US 8,308,910 B2
(45) Date of Patent: Nov. 13, 2012

(54) METHOD FOR MANUFACTURING PRESS FELT WITH SEAM, PRESS FELT, AND BASE FABRIC

(75) Inventors: Kati Mikkonen, Tampere (FI); Tauno Virtanen, Tampere (FI)

(73) Assignee: Metso Fabrics, Inc., Tampere (FI)

( * ) Notice: Subject to any disclaimer, the term of this patent is extended or adjusted under 35 U.S.C. 154(b) by 355 days.

(21) Appl. No.: 12/671,595

(22) PCT Filed: Sep. 24, 2008

(86) PCT No.: PCT/FI2008/050528

§ 371 (c)(1),
(2), (4) Date: Feb. 24, 2010

(87) PCT Pub. No.: WO2009/040469

PCT Pub. Date: Apr. 2, 2009

(65) Prior Publication Data

US 2011/0186256 A1 Aug. 4, 2011

(30) Foreign Application Priority Data

Sep. 28, 2007 (FI) ..... 20075682

(51) Int. Cl.
*D21F 7/08* (2006.01)
*D21F 7/10* (2006.01)

(52) U.S. Cl. ..... 162/358.2; 162/900; 162/904

(58) Field of Classification Search ..... 162/358.1, 162/358.2, 900, 902–904, 348; 139/383 A, 139/383 AA, 425 A; 28/110, 142; 442/270
See application file for complete search history.

(56) References Cited

U.S. PATENT DOCUMENTS

| | | | | |
|---|---|---|---|---|
| 4,187,618 | A | 2/1980 | Diehl | |
| 4,333,502 | A | 6/1982 | Karm | |
| 4,438,789 | A | 3/1984 | MacBean | |
| 4,503,113 | A | 3/1985 | Smart | |
| 4,896,702 | A | 1/1990 | Crook | |
| 4,940,630 | A | 7/1990 | Penven | |
| 5,277,967 | A * | 1/1994 | Zehle et al. | 442/206 |
| 5,891,516 | A | 4/1999 | Gstrein et al. | |
| 6,773,553 | B2 * | 8/2004 | Hyvonen et al. | 162/358.2 |
| 2005/0085148 | A1 | 4/2005 | Baumgartner et al. | |

FOREIGN PATENT DOCUMENTS

| | | | |
|---|---|---|---|
| EP | 1 643 024 | A2 | 4/2006 |
| FI | 110135 | B | 11/2002 |
| JP | A-2004-036020 | | 2/2004 |
| WO | WO 02/053834 | A1 | 7/2002 |
| WO | WO 2004/055265 | A1 | 7/2004 |

OTHER PUBLICATIONS

International Search Report issued in International Patent Application No. PCT/FI2008/050528 on Jan. 22, 2009.
International Preliminary Report on Patentability issued in International Patent Application No. PCT/FI2008/050528 on Aug. 17, 2009.
Finnish Office Action issued in Finnish Patent Application No. 20075682 on Jun. 19, 2008 (with translation).
Finnish Search Report issued in Finnish Patent Application No. 20075682 on Jun. 18, 2008 (with translation).

* cited by examiner

*Primary Examiner* — Eric Hug
(74) *Attorney, Agent, or Firm* — Oliff & Berridge, PLC

(57) ABSTRACT

A method for manufacturing a press felt with a seam, to a press felt, and a base fabric of a press felt. The base fabric is a one-base structure with machine direction yarns forming seam loops and further machine direction yarns running in the web-side surface layer. The machine direction yarns weave with cross yarns. The yarn ratio of the surface layer machine direction yarns to the intermediate layer and further the bottom layer machine direction yarns is at least 2:1:1. In addition, the surface layer machine direction yarns have a long run and their cross-sectional area is smaller than the yarns forming the seam loops.

20 Claims, 6 Drawing Sheets

METHOD FOR MANUFACTURING PRESS FELT WITH SEAM, PRESS FELT, AND BASE FABRIC

BACKGROUND OF THE INVENTION

The invention relates to a method for manufacturing a press felt with a seam, in which method a base fabric of the press felt is woven of several machine direction and cross-machine direction yarns, and at least part of the machine direction yarns are arranged to form seam loops to the cross-machine direction connecting edges of the base fabric. The seam loops can be arranged to overlap on the press section, whereby one or more seam yarns connecting the connecting ends can be arranged to the formed seam loop channel. Further, after weaving, one or more batt fibre layers are fastened to the base fabric at least on its web-side surface to make the structure denser.

The invention also relates to a press felt and its base fabric. The subject matters of the invention are defined in more detail in the preambles of the independent claims.

Press felts are used in a press section of a paper machine so that water in the web to be dried may penetrate into them. Depending on the structure of the press, the press felt may be arranged either on one side or on both sides of the web to be dried. The purpose of the press felt is after pressing to transport the water along in such a manner that it cannot re-enter the web. During pressing, the paper web is transported on the felt to a gap, or nip, between two rolls. The structure of the felt should be made so that in the nip, water is able to transfer easily from the web to the felt. Press felts comprise a base fabric that, among other things, provides the felt with the necessary water volume. To make the felt surface smooth, batt fibre is fastened at least to the web-side surface of the base fabric. The base fabric is typically made by weaving in a weaving machine.

It is further possible to form seam loops at the ends of the press felt during weaving so as to produce a press felt in the form of a closed loop by connecting the connecting ends. Mounting such a press felt with a seam onto a paper machine is in general easier and faster than mounting a press felt that is already in the form of a closed loop. The yarns making up the seam loops are relatively thick so as to provide sufficient tensile strength for the seam and so that the handling of the loops is easy while connecting the seam. However, the weaving points and seam loops of thick yarns of this type may cause marking on the web. Therefore, it is known to arrange a surface layer on the web-side surface of the web. However, present surface layers are not able to prevent the marking caused by the thick yarns that form the seam loops in a desired manner, which is why it is necessary to use a large number of batt fibres. A felt with a great deal of batt fibres tends to block. A problem thus arises from the insufficient ability of the present surface layers to protect the part of the bottom layer comprising the seam loops so as to avoid marking.

BRIEF DESCRIPTION OF THE INVENTION

It is an object of the present invention to provide a novel and improved method for manufacturing a press felt with a seam, and a novel and improved press felt with a seam, and its base fabric.

The method of the invention is characterised by arranging the yarn density ratio of the surface layer machine direction yarns to be at least double in comparison with the yarn density of the intermediate layer machine direction yarns and the yarn density of the bottom layer machine direction yarns, using as the surface layer machine direction yarns those with an essentially smaller cross-sectional area than that of the machine direction yarns forming seam loops, and arranging for the surface layer machine direction yarns a long free run over at least five cross-machine direction yarns.

The press felt of the invention is characterised in that the yarn density ratio of the surface layer machine direction yarns is at least double in comparison with the yarn density of the intermediate layer machine direction yarns and the yarn density of the bottom layer machine direction yarns, that the cross-sectional area of the surface layer machine direction yarns is smaller than that of the machine direction yarns forming seam loops, and that the surface layer machine direction yarns have a long free run over at least five cross-machine direction yarns.

The base fabric of the invention is characterised in that the yarn density ratio of the surface layer machine direction yarns is at least double in comparison with the yarn density of the intermediate layer machine direction yarns and the yarn density of the bottom layer machine direction yarns, that the cross-sectional area of the surface layer machine direction yarns is smaller than that of the machine direction yarns forming seam loops, and that the surface layer machine direction yarns have a long free run over at least five cross-machine direction yarns.

The idea of the invention is that at least two connecting ends to be connected to each other are formed on the base fabric of a single-base press felt. The base fabric has at least three layers, that is, it has machine direction yarns in at least three layers. Below the surface layer the machine direction yarns run in two layers. The several yarns in the intermediate and bottom layers are arranged to form connectable seam loops to connecting ends. A higher machine direction yarn density is arranged in the surface layer than in the intermediate layer or bottom layer. The ratio of the yarn densities, that is, the yarn ratio, is at least 2:1:1, which means that in the surface layer, the number of machine direction yarns per unit of measure is at least double in comparison with the intermediate and bottom layers. Further, the idea is that the cross-sectional area of the surface layer machine direction yarns is essentially smaller than that of the machine direction yarns forming the seam loops. In addition, the surface layer machine direction yarns have a long free run over at least five cross-yarns.

The invention provides the advantage that due to the surface layer the base fabric of the press felt has a smooth surface which makes it possible to avoid marking in the web being dried. By using a structure with a high machine direction yarn density, it is possible to provide a smooth surface for the surface layer. In addition, a batt fibre layer fastens well to a dense surface layer and is, therefore, wear-resistant. When the surface layer of the base fabric is smooth, the amount of needled batt fibre in the felt can be smaller. This way, it is also possible to prevent blockage of the felt. The smoothness of the surface layer can also be affected by using yarns having a smaller cross-sectional area. It is namely easier to arrange thin yarns than thick yarns more densely in the surface fabric and, further, it is easier to arrange the interweaving of thin yarns than thick yarns. In addition, yarns with a smaller cross-sectional area usually cause less marking than thick yarns. Instead, yarns forming seam loops are thick, whereby they are able to receive the machine direction forces generated during use. Seam loops made of thick yarns are also easier to handle when connecting the seam. Further, the long free run of the longitudinal yarns on the web-side surface of the surface fabric increases the contact area of the yarns, which in turn makes the surface fabric smoother and reduces marking. The weave of the surface layer may be satin-like.

The idea of an embodiment is that the yarn density ratio is at least 3:1:1, that is, the machine direction yarn density of the surface layer is at least triple in comparison with the intermediate and bottom layers.

The idea of an embodiment is that the yarn density ratio is at least 4:1:1, that is, the machine direction yarn density of the surface layer is at least fourfold in comparison with the intermediate and bottom layers.

The idea of an embodiment is that the machine direction yarns of the surface layer turn at the connecting end to a direction opposite to their direction of travel and do not form a connectable seam loop at the connecting end. When the surface layer machine direction yarns are turned backward, they need not be cut after weaving. In addition, a selvage is formed at the turning point, due to which the structure does not unravel easily.

The idea of an embodiment is that the machine direction yarns of the surface layer turn at the connecting end to a direction opposite to their direction of travel and form connectable seam loops at the connecting end. The surface layer of the base fabric may then have an auxiliary seam which may improve the strength of the seam. Further, it is possible to reduce the marking caused by the seam by using an auxiliary seam.

The idea of an embodiment is that the surface layer machine direction yarns turn at the connecting end to a direction opposite to their direction of travel in such a manner that the first section of the yarns towards the connecting end and the second section away from the connecting end run parallel on the same plane. In addition, the crossing of the first section running toward the connecting end and the crossing of the second section away from the connecting end with the cross-yarns take place at different points, whereby the side-by-side machine direction yarns endeavour to cover the weaving point where the longitudinal yarn runs under the cross-yarn. The surface layer machine direction yarns then settle tightly together and form a large contact area on the web-side surface.

The idea of an embodiment is that the surface layer machine direction yarns are at the connecting end turned around at least one cross-directional edge yarn to a direction opposite to their direction of travel. An edge yarn is a yarn separate from the rest of the structure of the base fabric and its structure and material may differ from the other cross-yarns of the weave. The edge yarn may be left in the base fabric or alternatively removed after weaving before the fastening of the batt fibre layer. The use of an edge yarn facilitates the turning of the surface layer machine direction yarns.

The idea of an embodiment is that the edge yarn is left in the base fabric and its cross-sectional area, structure, and material is selected to make the area denser between the seam loop channel and the basic weave. In addition, the edge yarn may be selected so that batt fibres can also be made to fasten well for instance by needling beside the seam channel. The edge yarn may be made of a folded monofilament or multifilament.

The idea of an embodiment is that the surface layer machine direction yarns are turned at the edge of the seam loop channel so that they do not extend over the seam loop channel. The turning point is thus at the boundary of the seam loop channel and basic weave.

The idea of an embodiment is that the surface layer machine direction yarns are turned at the seam loop channel as seen from the machine direction. The surface yarns then protect the seam area and also facilitate the fastening of batt fibre.

The idea of an embodiment is that the surface layer machine direction yarns extend at the first connecting end further than the midpoint of the seam loops and thus form a seam flap protecting the seam loop channel. Further the surface layer machine direction yarns are at the second connecting end turned before the midpoint of the seam loops and in relation to the length of the seam flap. The seam flap provides a good fastening base for the batt fibre layer and prevents the marking caused by the seam loops.

The idea of an embodiment is that the surface layer machine direction yarns are extended endlessly over the seam during weaving. The surface layer machine direction yarns are cut after the batt fibre has been fastened so that a seam flap may form.

The idea of an embodiment is that the cross-yarns of the base fabric have one yarn system. The use of one cross-yarn system enhances production as the warp yarn selection can be kept small.

The idea of an embodiment is that the cross-yarns of the base fabric have two yarn systems. By utilising two cross-yarn systems, it is possible to manufacture many variations of base fabrics by altering longitudinal yarns and cross-yarns.

The idea of an embodiment is that the ratio of the diameter of the yarns forming the seam loops in comparison with the surface layer machine direction yarns is at least 1.1-fold.

The idea of an embodiment is that the ratio of the diameter of the yarns forming the seam loops in comparison with the surface layer machine direction yarns is at least 1.6-fold.

The idea of an embodiment is that the yarns forming the seam loops are monofilaments having an essentially round cross-section and a diameter of 0.35 to 0.50 mm.

The idea of an embodiment is that the surface layer machine direction yarn is a monofilament or a folded monofilament.

The idea of an embodiment is that the cross-section of the surface layer machine direction yarn is round and its diameter is 0.1 to 0.35 mm.

The idea of an embodiment is that the cross-sectional diameter of the yarns forming the seam loops is 0.35 mm and the cross-sectional diameter of the surface layer machine direction yarns is 0.2 mm.

The idea of an embodiment is that the cross-section of the surface layer machine direction yarn is flat, for instance oval, elliptical, rectangular, or of some other form with a smaller dimension in the direction of thickness than in the direction of width of the base fabric.

The idea of an embodiment is that the cross-yarns are monofilaments or folded monofilaments.

BRIEF DESCRIPTION OF THE FIGURES

Some embodiments of the invention are described in more detail in the attached drawings in which.

In the figures some embodiments are shown simplified for the sake of clarity. Similar parts are marked with the same reference numbers.

DETAILED DESCRIPTION OF SOME EMBODIMENTS OF THE INVENTION

Figure 1:
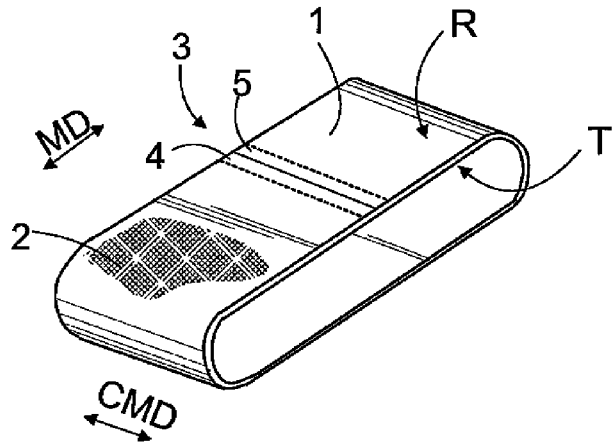
FIG. 1 is a schematic perspective view of a press felt.

FIG. 1 shows a press felt in the shape of a closed loop that can be run on a paper machine press section in the machine direction MD and that has a cross-machine direction CMD width. The press felt further has a surface R on the side of the web being dried and a roll surface T to be arranged against the rolls of the press section. The press felt comprises a one-base base fabric 1 and one or more batt fibre layers 2 fastened at least on the web-side surface R of the base fabric 1. The batt fibre layer 2 may also be fastened to the side of the roll surface T. Further, the base fabric 1 has at least one cross-machine direction CMD seam area 3 that connects a first connecting end 4 and a second connecting end 5 of the base fabric 1. The seam area 3 has a predefined width in machine direction MD. The seam area comprises at least the connecting ends with their seam loops and one or more seam yarns.

FIG. 1 shows a possible structure of the base fabric 1. The base fabric 1 has on the web-side surface R a surface layer A with several machine direction MD yarns, that is, longitudinal yarns 7. The longitudinal yarns 7 bind to cross-yarns 8 at weaving (or binding) points 9. The weave of the base fabric 1 is selected in such a manner that the weaving points 9 are at relatively long distances from each other, whereby the longitudinal yarns 7 of the surface layer A have a long free run on the web-side R surface. The longitudinal yarns 7 of the surface layer may run over five or more cross-yarns 8 and under one cross-yarn, that is, the longitudinal yarns 7 have a six-shaft weave structure. An as large a section as possible of the longitudinal yarn 7 then runs on the web-side surface R, which aids in providing a smooth surface.

Figure 2:
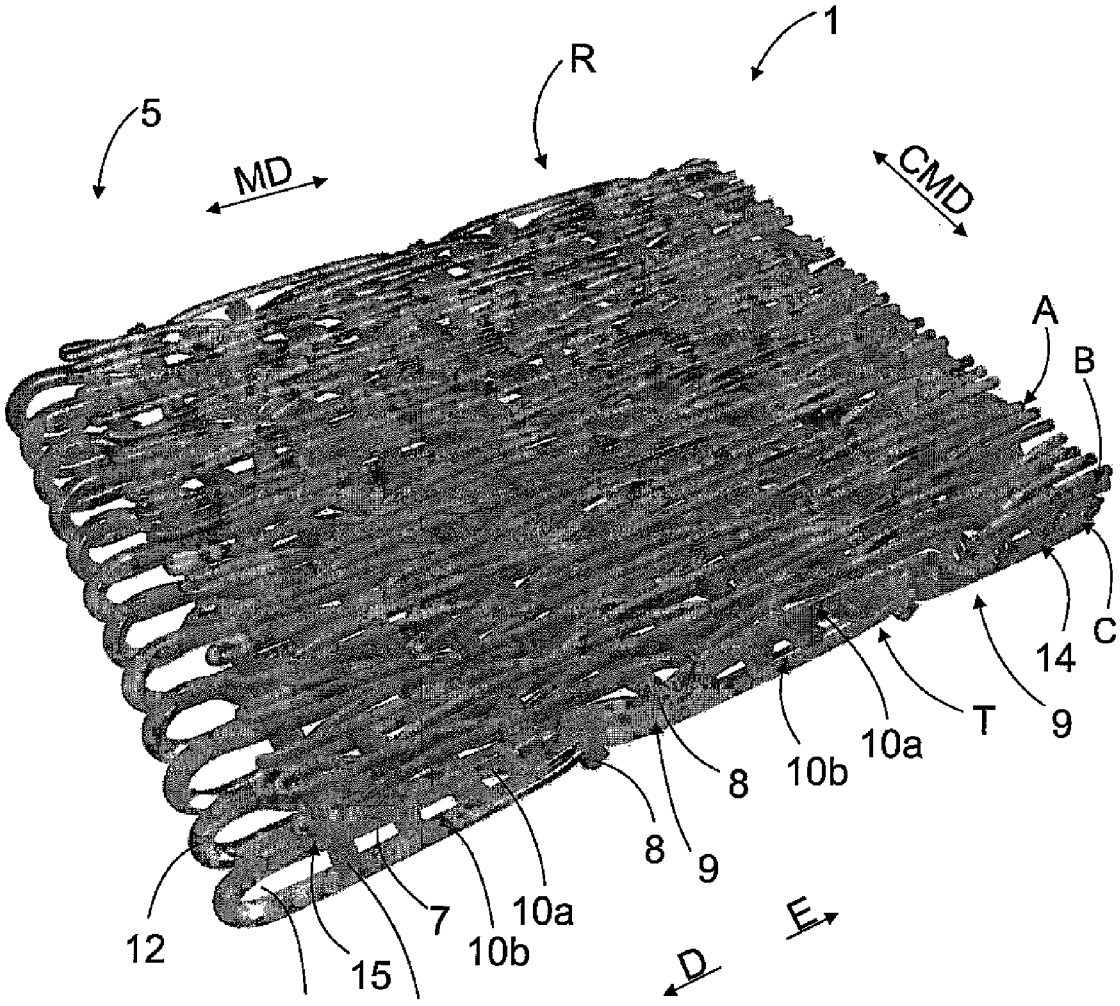
FIG. 2 is a schematic perspective view of a base fabric of the invention.

The base fabric further has machine direction MD yarns, that is, yarns 10*a*, 10*b* that form seam loops and are arranged to run on top of each other on different layers B and C. The yarns 10*a* run in the intermediate layer B and the yarns 10*b* run in the bottom layer C. At the connecting end 5 of the base fabric 1, the overlapping yarns 10 form seam loops 12 that may be arranged to interlace with corresponding other seam loops to form a seam channel 13 into which one or more seam yarns can be arranged. The yarns 10 forming seam loops 12 are selected to be sufficiently strong to endure the machine direction stresses directed to the press felt in the press section and to allow easy handling when connecting the seam. In contrast, the longitudinal yarns 7 of the surface layer A may be selected to be thinner than the yarns 10*a* and 10*b*, because they need not participate in receiving the machine direction MD loads. The longitudinal yarns 7 form on the web-side surface R of the base fabric 1*a* smooth layer, whereby marking may be avoided. FIG. 2 also shows how the longitudinal yarn 7 of the surface layer A may be turned at the connecting end 5 at a turning point 15 to a direction E opposite to the direction of travel D. For this turning, the connecting end 5 may have one or more edge yarns 16 around which the longitudinal yarn 7 turns and continues in the return direction E beside the yarn section running in the forward direction D. The longitudinal yarn 7 forms a loop, but it is not intended for connection and may be at a distance from the seam channel 13. In addition, the edge yarn 16 may be left in place in the base fabric 1. Even if the edge yarn 16 was removed, the thus formed free loops are still not used for connecting. Thus, the twisting of the edge yarns 16 at the turning point 15 does not matter. Further, it may be possible to arrange at the connecting end 5 two or more turning points 15 at different distances from the seam channel 13, whereby the longitudinal yarns 7 of the surface layer A are arranged to turn at two or more points.

Figure 3:
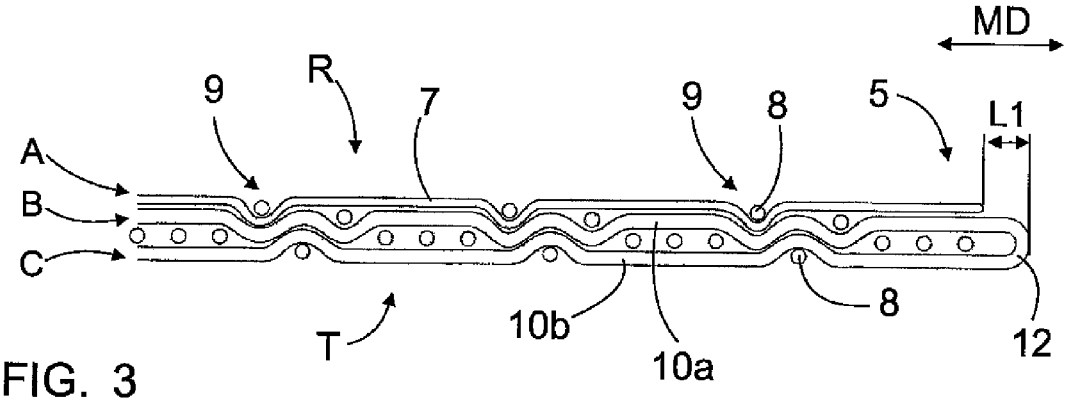
FIG. 3 is a schematic cross-machine direction CMD view of a connecting end of a base fabric of the invention.

FIG. 3 shows the structure of the connecting end 5 in cross-machine direction CMD and in a highly simplified manner. The figure shows that the turning point 15 may be at a distance L1 from the outermost part of the connecting end.

Figure 4:
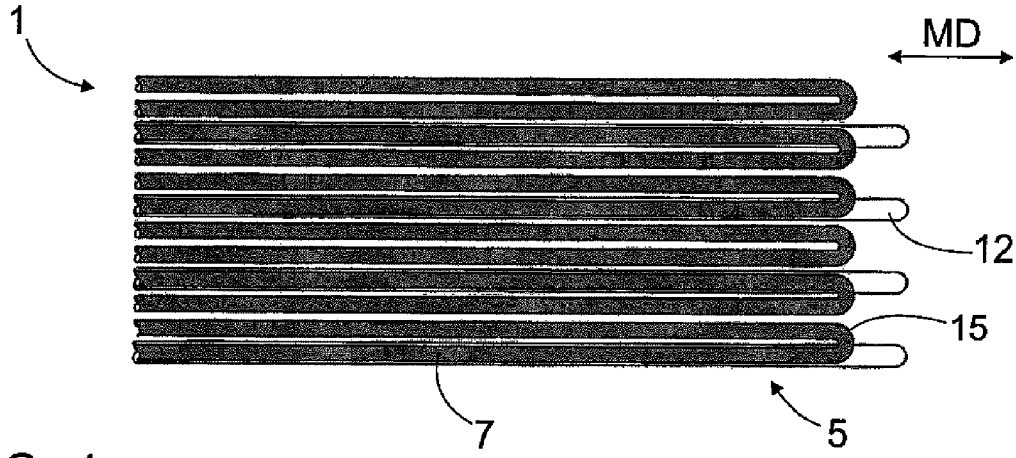
FIG. 4 is a schematic web-side view of a connecting end of a base fabric of the invention.
Figure 5:
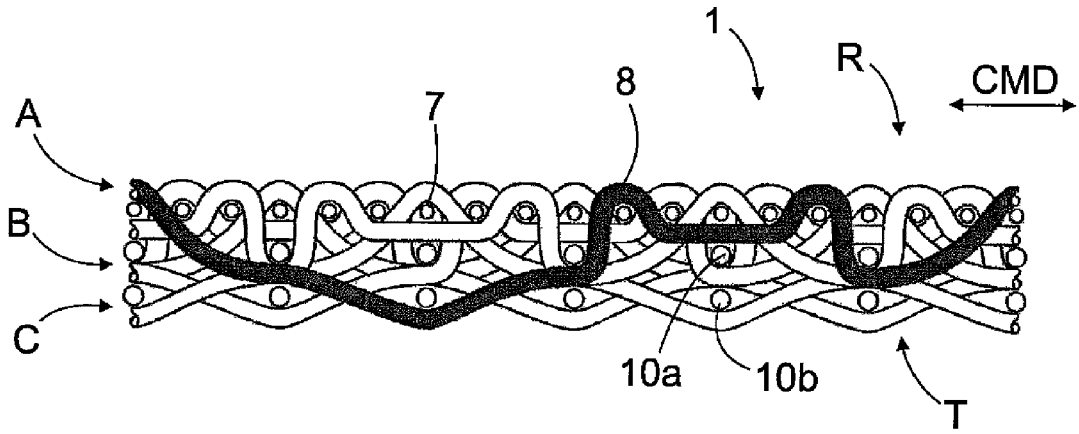
FIGS. 5 to 10 are schematic machine direction MD views of possible weave structures of base fabrics of the invention.

FIG. 4 shows the connecting end 5 of the base fabric 1 from the web-side surface and in a highly simplified manner. FIG. 5 shows how the longitudinal yarns 7 running in the surface layer A turn at the turning point 15 and run parallel and on the same level toward the connecting end 5 and away from the connecting end. The longitudinal yarns 7 then have a long run on the web-side surface R.

FIGS. 5 to 10 show from the machine direction MD some possible cross-yarn 8 runs and binding with the longitudinal yarns 7 of the surface layer A and the yarns 10*a*, 10*b* forming the seam loops.

FIG. 5 shows a 6-shaft weave in which the yarn ratio of the machine direction yarns 7 of the surface layer A to the machine direction yarns 10*a*, 10*b* of the intermediate layer B and bottom layer C, respectively, is 3:1, that is, for one loop yarn pair, the surface layer A has three machine direction yarns 7. The base fabric 1 of FIG. 5 has one cross-machine direction CMD yarn system, in which case each cross-yarn 8 weaves with the machine direction yarns 7, 10*a*, 10*b* of all yarn layers A, B, and C in the order defined by the weave pattern repeat. Each cross-yarn 8 in the weave has a similar run pattern.

Figure 6:
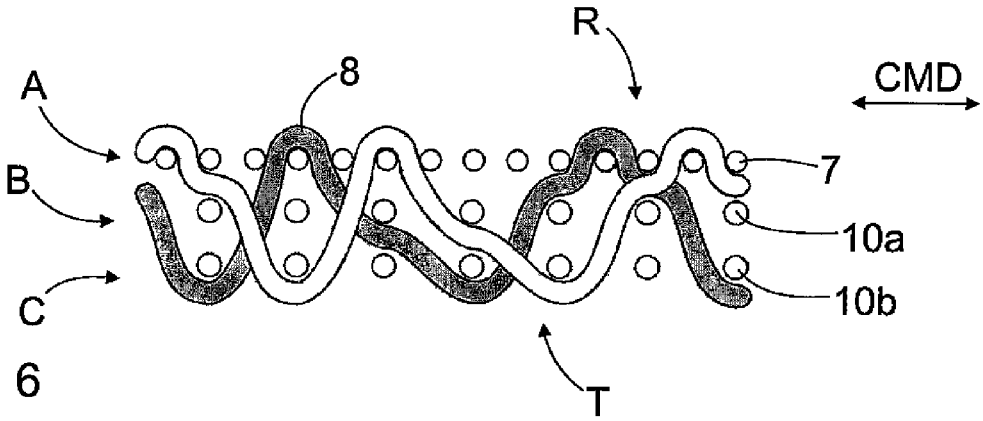

FIG. 6 shows a 6-shaft weave in which the yarn ratio of the machine direction yarns 7 of the surface layer A to the machine direction yarns 10*a*, 10*b* of the intermediate layer B and bottom layer C, respectively, is 2:1, that is, for one loop yarn pair, the surface layer A has two machine direction yarns 7. The base fabric 1 of FIG. 6 has one cross-machine direction CMD yarn system, in which case each cross-yarn 8 weaves with the machine direction yarns 7, 10*a*, 10*b* of all yarn layers A, B, and C in the order defined by the weave pattern repeat. Each cross-yarn 8 in the weave has a similar run pattern.

Figure 7:
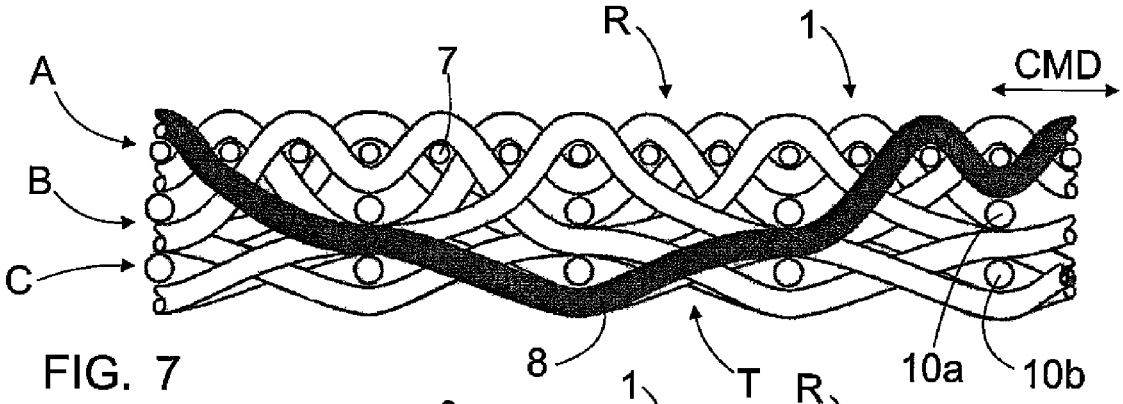

FIG. 7 shows an 8-shaft weave in which the yarn ratio between the layers A, B, and C is 3:1:1. This base fabric 1 also has one cross-machine direction CMD yarn system, in which case each cross-yarn 8 weaves with the machine direction yarns 7, 10*a*, 10*b* of all yarn layers A, B, and C in the order defined by the weave pattern repeat. Each cross-yarn 8 in the weave has a similar run pattern.

Figure 8:
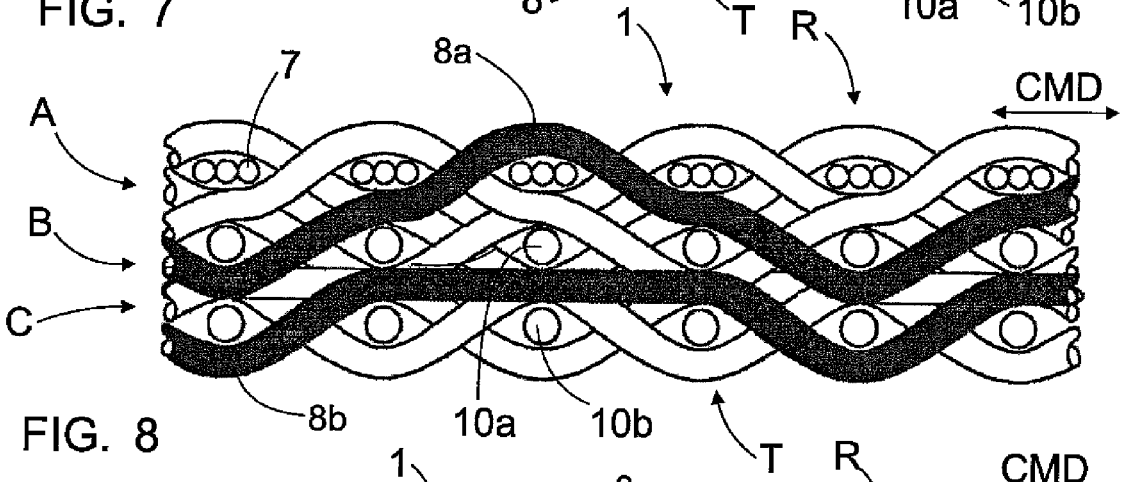

FIG. 8 shows another 8-shaft weave in which the yarn ration between the layers A, B, and C is 3:1:1. In this embodiment, the machine direction yarns 7 of the surface layer A are arranged in groups of three yarns. The base fabric 1 has two cross-machine direction CMD yarn systems. The first cross-yarns 8*a* bind the machine direction yarns 7 of the surface layer A with the machine direction yarns 10*a* of the intermediate layer B. The second cross-yarns 8*b* only crisscross in the bottom layer C. With a few modifications, this structure can also be implemented so that it only has one cross-machine direction CMD yarn system.

Figure 9:
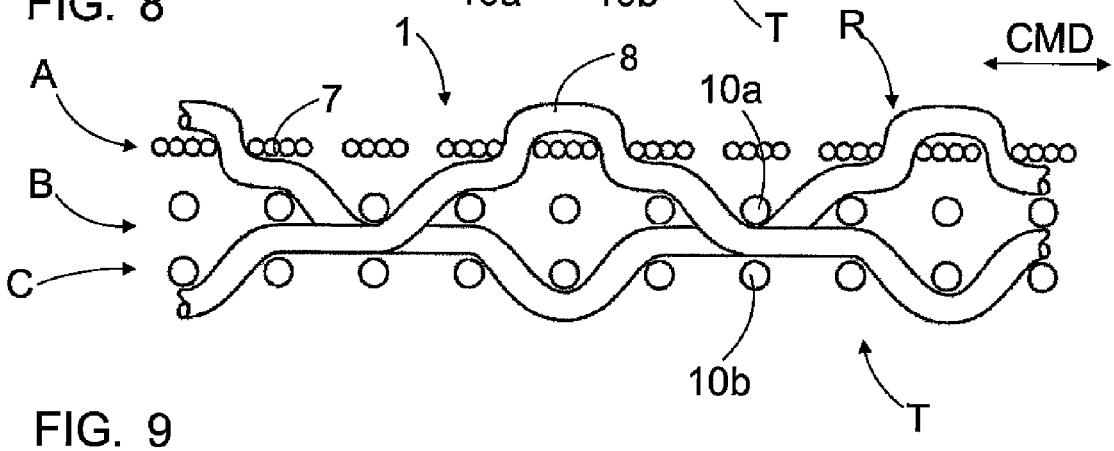

FIG. 9 shows a weave in which the surface layer A comprises four machine direction yarns 7 per one loop yarn pair 10*a*, 10*b*. The yarn ratios of the machine direction yarns are then 4:1:1 calculated from the web-side R surface. The machine direction yarns 7 of the surface layer A are arranged into groups of four yarns. The base fabric 1 has one cross-yarn 8 system.

Figure 10:
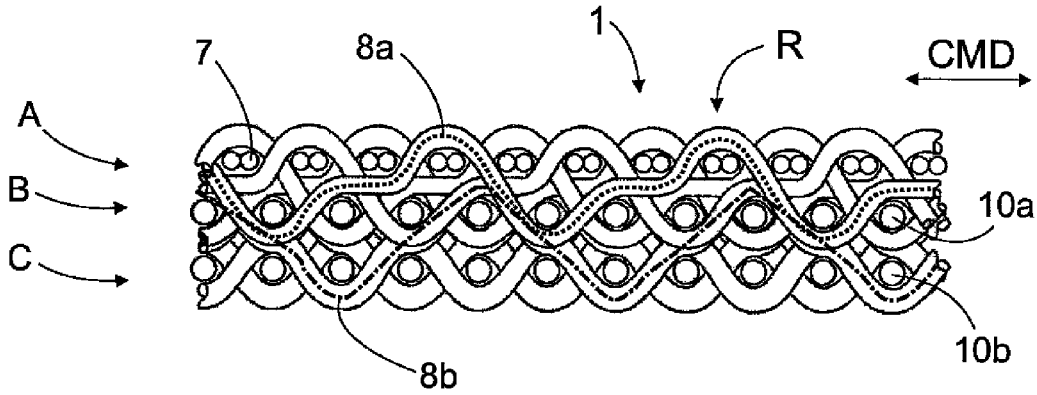

FIG. 10 shows a base fabric 1 with two independent cross-machine direction CMD yarn systems. The first cross-yarn 8*a* is marked with a dashed line and crisscrosses with the machine direction yarns 7 of the surface layer A and the machine direction yarns 10*a* of the intermediate layer B. The second cross-yarn 8*b* is marked with a dot-and-dash line and crisscrosses with the machine direction yarns 10*a*, 10*b* of the intermediate layer B and bottom layer C. In the weave of the figure, the yarn ratio of the yarns 7 to the yarns 10*a*, 10*b* forming seam loops is 2:1:1. The yarns 7 are in groups of two yarns.

Figure 11:
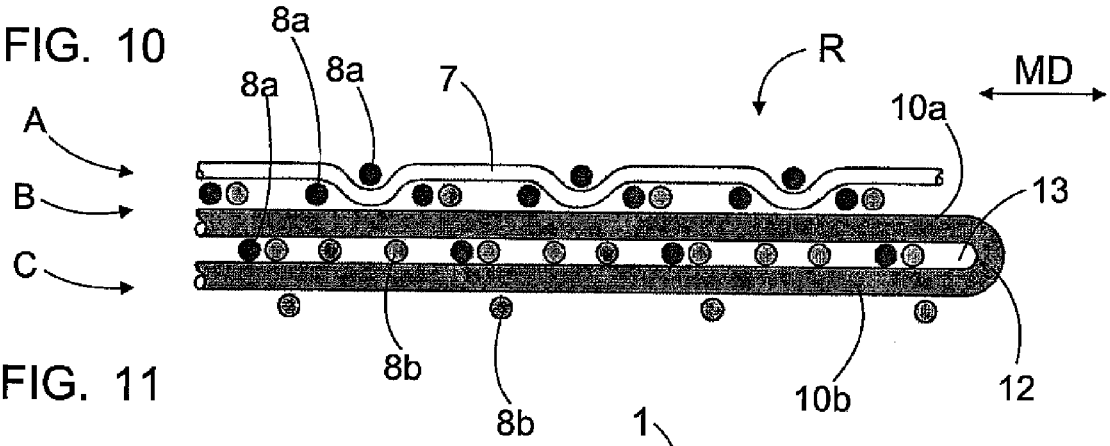
FIG. 11 is a schematic cross-machine direction CMD view of a weave structure of a base fabric of the invention.

FIG. 11 shows in cross-machine direction CMD a structure of the base fabric 1. The base fabric 1 may have two yarn systems in cross-machine direction CMD. At least some of the cross-yarns 8*a* of the surface layer A may be arranged to bind with the machine direction yarns 10*a* of the intermediate layer B. Alternatively, the cross-yarns 8*a* of the surface layer A may crisscross only with the machine direction yarns 7 of the surface layer A, whereby at least some of the cross-yarns 8*b* crisscrossing in the intermediate layer B and bottom layer C weave at given weaving points with the machine direction yarns 7 of the surface layer A. It is yet possible that at least some of the cross-yarns 8*a* weave with the yarns 10*a* and at least some of the cross-yarns 8*b* weave with the yarns 7.

FIGS. 12 to 18 show seams and seam areas between the connecting ends 4 and 5 as highly simplified representations.

Figure 12:
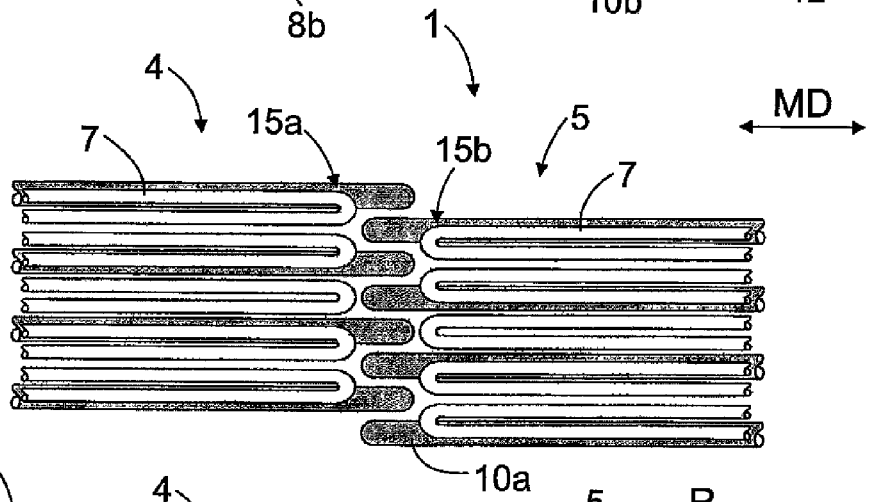
FIG. 12 is a schematic web-side view of a base fabric in which the surface layer machine direction yarns are turned backward at the root of the seam channel.
Figure 13:
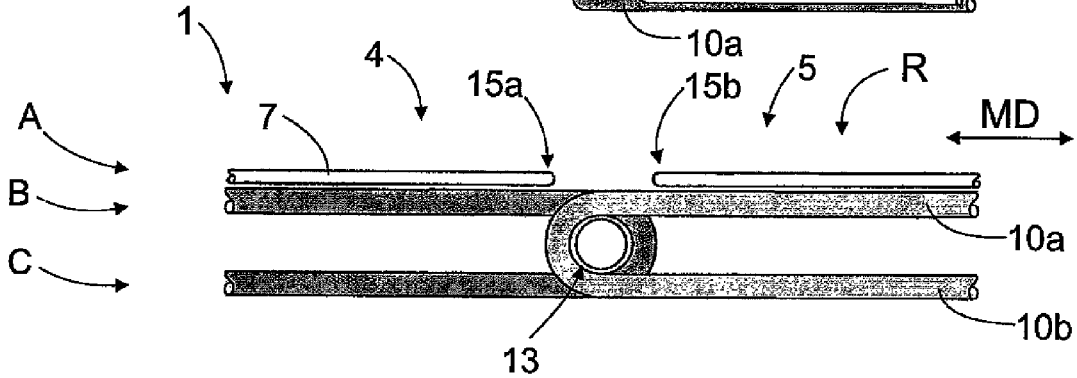
FIG. 13 is a schematic cross-machine direction CMD view of the connecting ends of the base fabric of FIG. 12.

In FIGS. 12 and 13, the turning points 15*a*, 15*b* of the machine direction yarns 7 of the surface layer A are at each connecting end 4 and 5 right at the edge of the seam loop channel, whereby the yarns 7 do not extend on top of the actual seam area.

Figure 14:
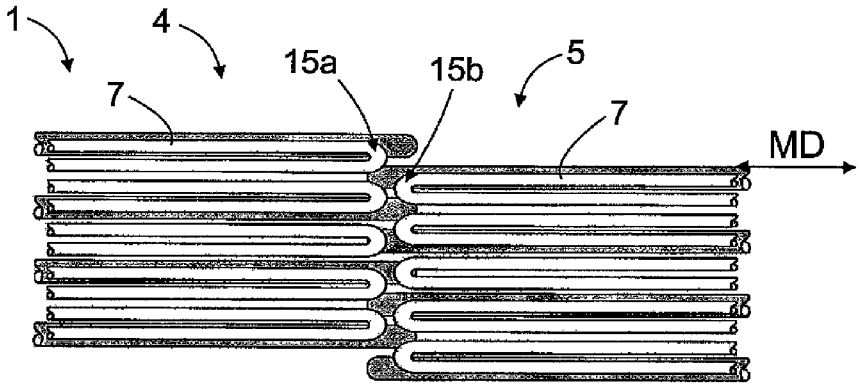
FIG. 14 is a schematic web-side view of a base fabric in which the surface layer machine direction yarns are turned backward at the seam channel.
Figure 15:
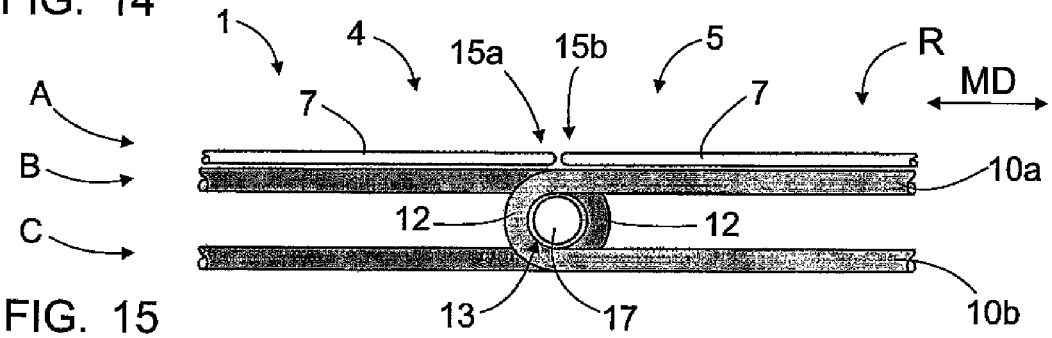
FIG. 15 is a schematic cross-machine direction CMD view of the connecting ends of the base fabric of FIG. 14.

In FIGS. 14 and 15, the turning points 15*a*, 15*b* of the machine direction yarns 7 of the surface layer A are at the seam loop channel, whereby the yarns 7 of each connecting end 4 and 5 extend on top of the seam area.

Figure 16:
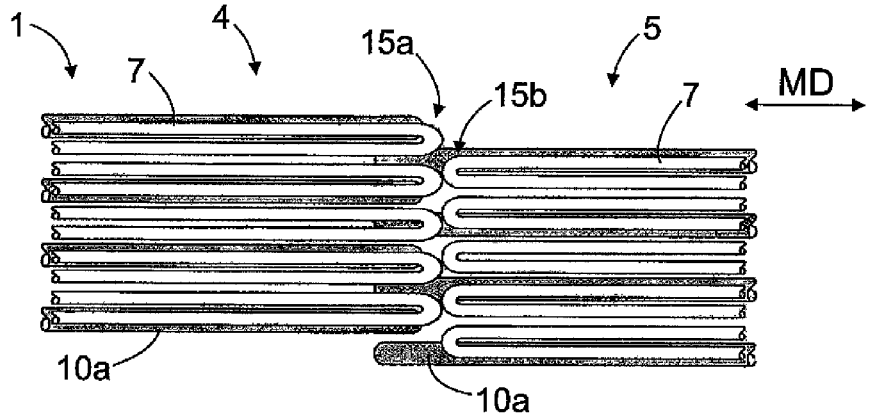
FIG. 16 is a schematic web-side view of a base fabric in which the surface layer machine direction yarns of the left-side connecting end form a seam flap covering the seam channel.
Figure 17:
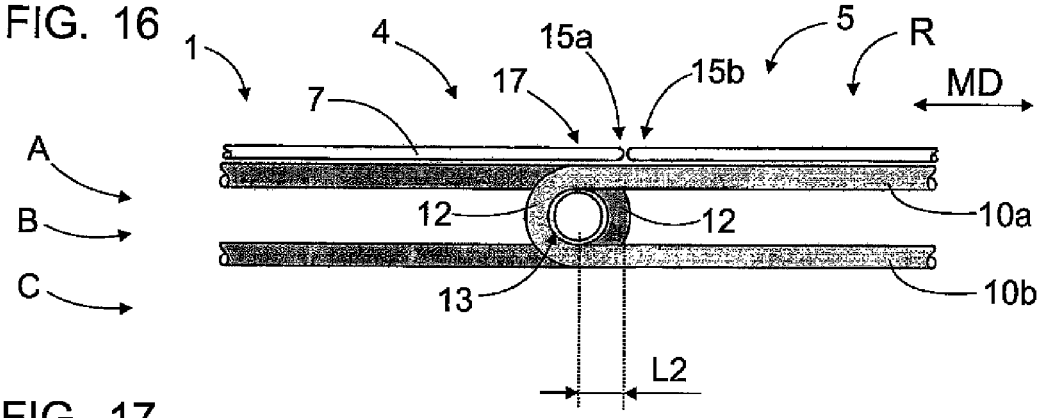
FIG. 17 is a schematic cross-machine direction CMD view of the connecting ends of the base fabric of FIG. 16.

In FIGS. 16 and 17, the turning point 15*a* of the machine direction yarns 7 of the surface layer A of the first connecting end 4 is at a distance L2 from the midpoint of the seam channel and, thus, extends until the basic weave of the second connecting end 5 and forms a seam flap 17 that protects the seam area. The length of the seam flap 17 can naturally be dimensioned as required to be shorter or longer. The turning point 15*b* of the yarns 7 of the second connecting end 5 is at a corresponding distance L2 from the midpoint of the seam channel toward the basic weave.

Figure 18:
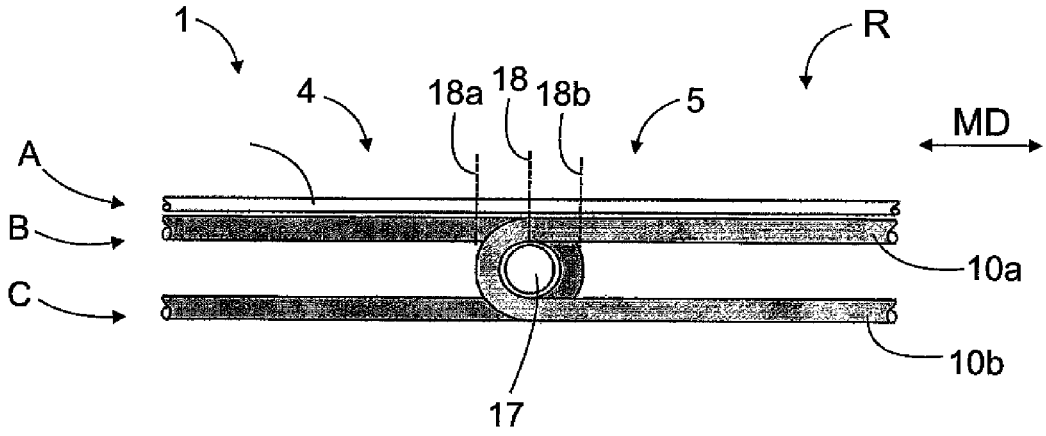
FIG. 18 is a schematic cross-machine direction CMD view of a base fabric in which the surface layer machine direction yarns are woven unbroken over the seam channel and the seam is only cut open after weaving.

FIG. 18 shows a seam in which the machine direction yarns 7 of the surface layer A are woven unbroken over the seam area. After weaving the yarns 7 are cut at a desired cutting point 18. The cutting point 18 may be at the seam channel, for instance, or located so that a seam flap is formed. Further, it is possible to use two cutting points 18*a*, 18*b* so that the yarns 7 are cut at the edge of the seam area and, thus, do not extend over the seam area.

The used yarns may be described as follows. The machine direction yarns 7 of the surface layer A may be monofilaments. In some cases, it is also possible to use folded mono- or multifilament yarns. The cross-sectional shape of the machine direction yarns 7 of the surface layer A may be round and their diameter 0.1 to 0.35 mm. The yarns 7 may also have a flat cross-section, such as an oval, ellipse, or a rectangle rounded at the edges. The machine direction yarns 10*a*, 10*b* forming the seam loops 12 may be round in cross-section. Their diameter may be 0.35 to 0.50 mm. However, the yarns 10*a*, 10*b* are always thicker than the machine direction yarns 7 of the surface layer. The yarns 10*a*, 10*b* may be monofilaments. Further, the cross-yarns 8 may be monofilaments or folded monofilaments. The cross-sectional profile of the cross-yarns may be round or flat or they may have any cross-sectional profile.

The base fabric of the invention should have an as smooth web-side surface as possible. To achieve this, it is possible to select for the machine direction yarns of the surface layer a smaller cross-sectional area than for the yarns forming the seam loops. The yarn density of the surface layer then becomes higher. Further, it is possible to select a weave in which the machine direction yarns of the surface layer have a long run on the web-side surface. In addition, the weaving points of the yarns having a long run may be positioned so that they settle as far away as possible from the weaving points of adjacent yarns. The long runs may then due to weaving tension, high yarn density, and heat treatment push onto the weaving points and cover them at least partly. The use of such a satin or satinet weave may produce a smooth surface for the base fabric.

It should yet be noted that in the embodiments described above, the surface layer, intermediate layer, and bottom layer of the base fabric are woven together using the cross-yarns in the base fabric, that is, in the section between the seam areas which are located at the ends. The layers are then woven using a large number of weaving points, and the base fabric is, thus, a stable one-base structure.

In some cases, the features presented in this application may be used as such, regardless of the other features. On the other hand, the features presented in this application may, if necessary, be combined to form different combinations.

The drawings and the related description are only intended to illustrate the idea of the invention. The invention may vary in detail within the scope of the claims.

What is claimed is:

1. A method for manufacturing a press felt with a seam for the press section of a paper machine, the method comprising:

weaving in a weaving machine in one go a one-base three-layer base fabric that comprises a web-side surface layer, an intermediate layer and further a bottom layer on the roll-side surface, weaving in the base fabric several machine direction yarns in three layers and several cross-machine direction yarns that are arranged to cross with the machine direction yarns, forming in the base fabric at least a first and a second cross-machine direction connecting end, forming at the connecting ends by means of the machine direction yarns of the intermediate layer and bottom layer several seam loops for forming a seam, fastening after weaving at least to the web-side surface of the base fabric at least one batt fibre layer, arranging the yarn density ratio of the surface layer machine direction yarns to be at least double in comparison with the yarn density of the intermediate layer machine direction yarns and that of the bottom layer machine direction yarns, respectively, using as the surface layer machine direction yarns those having an essentially smaller cross-sectional area in comparison with the machine direction yarns forming the seam loops, and arranging for the surface layer machine direction yarns a long free run over at least five cross-machine direction yarns.

2. A method as claimed in claim 1, comprising weaving the base fabric cross-machine direction yarns by using one cross-machine direction yarn system.

3. A method as claimed in claim 1, comprising weaving the base fabric cross-machine direction yarns by using two cross-machine direction yarn systems.

4. A method as claimed in claim 1, comprising turning the machine direction yarns running in the surface layer at the connecting end into a direction opposite to their direction of travel without forming seam loops.

5. A method as claimed in claim 1, comprising turning the machine direction yarns running in the surface layer at the connecting end into a direction opposite to their direction of travel to form connectable seam loops at the same time.

6. A method as claimed in claim 1, comprising turning the surface layer machine direction yarns at the connecting end around at least one cross-machine direction edge yarn into a direction opposite to their direction of travel.

7. A method as claimed in claim 1, comprising turning the surface layer machine direction yarns at the connecting end around at least one cross-machine direction edge yarn into a direction opposite to their direction of travel, and removing said edge yarn after weaving and before attaching the batt fibre.

8. A method as claimed in claim 1, comprising extending the surface layer machine direction yarns over the seam area during weaving, and cutting the surface layer machine direction yarns at the seam area after weaving.

9. A paper machine press section press felt comprising:

a one-base woven base fabric with three layers on top of each other, namely a web-side surface layer, intermediate layer and bottom layer on the roll-side surface, several machine direction yarns and several cross-machine direction yarns that cross each other, at least a first and a second cross-machine direction connecting end, several seam loops at the connecting ends for forming a seam, the seam loops being formed by at least some of the machine direction yarns of the intermediate and bottom layers, at least one batt fibre layer fastened to the at least the web-side surface of the base fabric, and wherein the yarn density ratio of the surface layer machine direction yarns is at least double in comparison with the yarn density of the intermediate layer machine direction yarns and that of the bottom layer machine direction yarns, respectively, the cross-sectional area of the surface layer machine direction yarns is smaller in comparison with that of the machine direction yarns forming the seam loops, and the surface layer machine direction yarns have a long free run over at least five cross-machine direction yarns.

10. A base fabric of a press felt of a paper machine press section which comprises:

a one-base woven base fabric with three layers on top of each other, namely a web-side surface layer, intermediate layer and bottom layer on the roll-side surface, several machine direction yarns and several cross-machine direction yarns that cross each other, at least a first and a second cross-machine direction connecting end, several seam loops at the connecting ends for forming a seam, the seam loops being formed by at least some of the machine direction yarns of the intermediate and bottom layers, and wherein the yarn density ratio of the surface layer machine direction yarns is at least double in comparison with the yarn density of the intermediate layer machine direction yarns and the bottom layer machine direction yarns, respectively, the cross-sectional area of the surface layer machine direction yarns is smaller in comparison with that of the machine direction yarns forming the seam loops, and the surface layer machine direction yarns have a long free run over at least five cross-machine direction yarns.

11. A base fabric as claimed in claim 10, comprising the yarn density ratio of the surface layer machine direction yarns is at least triple in comparison with the yarn density of the intermediate layer machine direction yarns and the bottom layer machine direction yarns, respectively.

12. A base fabric as claimed in claim 10, comprising the yarn density ratio of the surface layer machine direction yarns is at least fourfold in comparison with the yarn density of the intermediate layer machine direction yarns and the bottom layer machine direction yarns, respectively.

13. A base fabric as claimed in claim 10, comprising the base fabric has one cross-machine direction yarn system.

14. A base fabric as claimed in claim 10, comprising the base fabric has two cross-machine direction yarn systems.

15. A base fabric as claimed in claim 10, comprising the surface layer machine direction yarns are turned at the connecting end into a direction opposite to their direction of travel without forming a connectable seam loop at the connecting end.

16. A base fabric as claimed in claim 10, comprising the surface layer machine direction yarns are turned at the connecting end into a direction opposite to their direction of travel without forming a connectable seam loop at the connecting end, and the turned machine direction yarns return from the connecting end in the surface layer.

17. A base fabric as claimed in claim 10, comprising the surface layer machine direction yarns are turned at the connecting end into a direction opposite to their direction of travel without forming a connectable seam loop at the connecting end, and the surface layer machine direction yarns are turned at the edge of a seam loop channel without extending on top of the seam loop channel.

18. A base fabric as claimed in claim 10, comprising the surface layer machine direction yarns are turned at the connecting end into a direction opposite to their direction of travel without forming a connectable seam loop at the connecting end, and the surface layer machine direction yarns are turned at the seam loop channel as seen from the machine direction.

19. A base fabric as claimed in claim 10, comprising the surface layer machine direction yarns are turned at the connecting end into a direction opposite to their direction of travel without forming a connectable seam loop at the connecting end, the surface layer machine direction yarns extend at the first connecting end further than the midpoint of the seam loops, whereby they form a seam flap protecting the seam loop channel, and the surface layer machine direction yarns are turned at the second connecting end before the midpoint of the seam loops and in relation to the length of the seam flap.

20. A base fabric as claimed in claim 10, comprising the surface layer machine direction yarns are extended over the seam area during weaving, and the surface layer machine direction yarns are cut after weaving to open the seam area.

* * * * *